United States Patent [19]

Nelson et al.

[11] Patent Number: 4,634,612

[45] Date of Patent: Jan. 6, 1987

[54] DECORATIVE RIBBON AND SHEET MATERIAL

[75] Inventors: David L. Nelson, Woodbury; Bernard S. Truskolaski; Paul E. Hansen, both of Lake Elmo, all of Minn.

[73] Assignee: Minnesota Mining and Manufacturing Company, St. Paul, Minn.

[21] Appl. No.: 722,234

[22] Filed: Apr. 15, 1985

[51] Int. Cl.[4] ..... D04D 7/10

[52] U.S. Cl. ..... 428/4; 156/178; 156/181; 223/46; 428/114; 428/286

[58] Field of Search ..... 156/178, 181; 223/46; 428/4–5, 114, 284, 286, 294

[56] References Cited

U.S. PATENT DOCUMENTS

| | | | |
|---|---|---|---|
| 2,358,761 | 9/1944 | Reed | 428/152 |
| 2,626,883 | 1/1953 | Boese | 428/290 |
| 3,449,187 | 6/1969 | Bobkowicz | 428/294 X |
| 3,637,455 | 1/1972 | Pearson et al. | 428/4 |
| 3,676,277 | 7/1972 | Truskolaski | 428/4 |
| 4,164,600 | 8/1979 | Yung et al. | 428/374 X |
| 4,329,382 | 5/1982 | Truskolaski et al. | 428/4 |
| 4,374,894 | 2/1983 | Antlfinger | 428/290 X |
| 4,449,652 | 5/1984 | Coppins et al. | 428/4 X |
| 4,473,611 | 9/1984 | Haq | 428/211 X |
| 4,476,168 | 10/1984 | Aoyama | 428/4 |
| 4,490,427 | 12/1984 | Grant et al. | 428/294 X |
| 4,585,676 | 4/1986 | De Smet et al. | 223/46 X |

FOREIGN PATENT DOCUMENTS

| | | |
|---|---|---|
| 1940465 | 2/1970 | Fed. Rep. of Germany . |
| 0095646 | 12/1983 | European Pat. Off. . |

*Primary Examiner*—Henry F. Epstein

*Attorney, Agent, or Firm*—Donald M. Sell; James A. Smith; David L. Weinstein

[57] ABSTRACT

This invention relates to decorative sheet useful for making ribbons, bows, and the like. The invention relates to the field of synthetic textiles.

The decorative sheet material comprises (a) a thermally bonded nonwoven tissue-like base layer having at least 50 weight percent polymeric, staple fibers having a length of ¼ to 6 inches, and up to about 50 weight percent other fibrous material, at least the outer portion of said fibers being thermally bondable, and (b) at least a monolayer of a multiplicity of substantially parallel, continuous, non-cellulosic, multifilament yarns substantially covering a first side of said base layer and thermally laminated to said base layer, at least one side of said base layer being sonically bondable to a fibrous substrate. By making the base layer out of a sonically bondable material, articles made of the sheet material of this invention can be rapidly produced. The sheet material can be used to prepare such products as ribbon, pressure-sensitive adhesive tape, laminates, embossed products, and molded products.

27 Claims, 9 Drawing Figures

DECORATIVE RIBBON AND SHEET MATERIAL

BACKGROUND OF THE INVENTION

1. Field of the Invention

This invention relates to decorative sheet material, a process for producing decorative sheet material, and to products, such as ribbon, pressure-sensitive adhesive tape, laminated products, embossed products and molded products, produced therefrom.

2. Description of the Background Art

The three primary types of decorative ribbon in widespread use today are woven yarn-based ribbon, nonwoven yarn-based ribbon, and foamed, oriented, polypropylene-based ribbon.

The woven yarn-based ribbons are generally the finest ribbons in terms of yarn-like luster, texture, feel, and quality of color. Although the quality of such ribbon is high, manufacturing costs are also relatively high.

The foamed, oriented, polypropylene-based ribbons generally do not offer the aesthetics obtainable with the woven yarn-based ribbons, since these ribbons are generally stiff and have a plastic-appearing surface rather than the yarn-like luster of the woven yarn-based ribbons. An advantage found in these polypropylene-based ribbons is that they can be thermally welded, e.g., by sonic sealing, to form ribbon assemblies, such as those described in U.S. Pat. Nos. 3,637,455 and 4,329,382.

Nonwoven yarn-based ribbons, such as described in U.S. Pat. No. 2,626,883, possess the excellent aesthetics of yarn-like luster, texture, feel, and quality of color found in woven yarn-based ribbons, and can be manufactured much less expensively than the woven yarn-based ribbons. The ribbon described in U.S. Pat. No. 2,626,883 has a tissue-like web of staple viscose rayon fibers and plasticized staple acetate rayon fibers autogenously interbonded at their crossing points to form a network. A monolayer of aligned yarns of non-plasticized continuous acetate rayon filaments is autogenously bonded onto one face of the web of the plasticized acetate rayon fibers.

This composite is impregnated by sizing that superficially coats the yarns. Although the aesthetics of this nonwoven yarn-based ribbon are excellent and manufacturing expenses are less than for producing the woven yarn-based ribbon, deficiencies in the nonwoven yarn-based ribbon are present. The volatile plasticizer used on the staple acetate rayon fibers is costly and requires the use of expensive processing equipment such as oven filter scrubbers. Additionally, such ribbon cannot be thermally bonded to form ribbon assemblies, but must be bonded by applying adhesive to the areas to be bonded, a method generally more difficult to control than thermal bonding.

The present invention provides a decorative sheet material which has the excellent aesthetics of the nonwoven yarn-based ribbon material and thermal sealability of the polypropylene film-based ribbon.

SUMMARY OF THE INVENTION

The present invention provides decorative sheet material which has a thermally bonded nonwoven tissue-like base layer of at least about 50 weight percent thermally bondable polymeric staple fibers. The base layer may optionally contain up to about 50 weight percent other fibrous material and/or thermally bondable resin fillers. Thermally laminated to the base layer is a multiplicity of substantially parallel, continuous, multifilament, non-cellulosic thermoplastic yarns which substantially cover one side of the base layer. An optional protective sizing layer may be applied over the multifilament yarns. The sheet material can be dyed or printed to achieve desired coloration or a metallic finish can be applied to the non-cellulosic thermoplastic yarn surface, e.g., by vapor deposition, to achieve desired surface effects. Coloration can also be attained by using pre-dyed multifilament yarns. The base layer side of the decorative sheet material is heat sealable to fibrous substrates. Such heat sealability permits the sheet material to be thermally welded to form ribbon assemblies and to be directly laminated to fibrous substrates. The decorative sheet material is also thermally formable and can be molded or embossed.

The present invention also provides a process for producing the decorative sheet material. A tissue-like nonwoven web of the thermally bondable polymeric fibers is formed. A multiplicity of multifilament non-cellulosic, thermoplastic yarns are laid on the base layer in close parallel arrangement to substantially cover the surface of one side of the base layer and are bonded to the base layer by heating the yarn covered base layer under sufficient temperature and pressure to effect bonding.

The present invention further provides products produced from the decorative sheet material. The sheet material can be slit to form ribbon. The ribbon is particularly useful in ribbon assemblies because it can be thermally welded. The sheet material can be coated with a pressure-sensitive adhesive to provide pressure-sensitive adhesive material. The sheet material can be thermally bonded to fibrous substrates, for example, paper stock, to provide decorative products such as matchbook covers, greeting cards, and boxes. The decorative sheet product can be molded to form interesting and decorative shapes and adornments. The decorative sheet product can be embossed to modify the filament surface, thereby providing a woven fabric appearance.

DETAILED DESCRIPTION OF THE INVENTION

Figure 1:
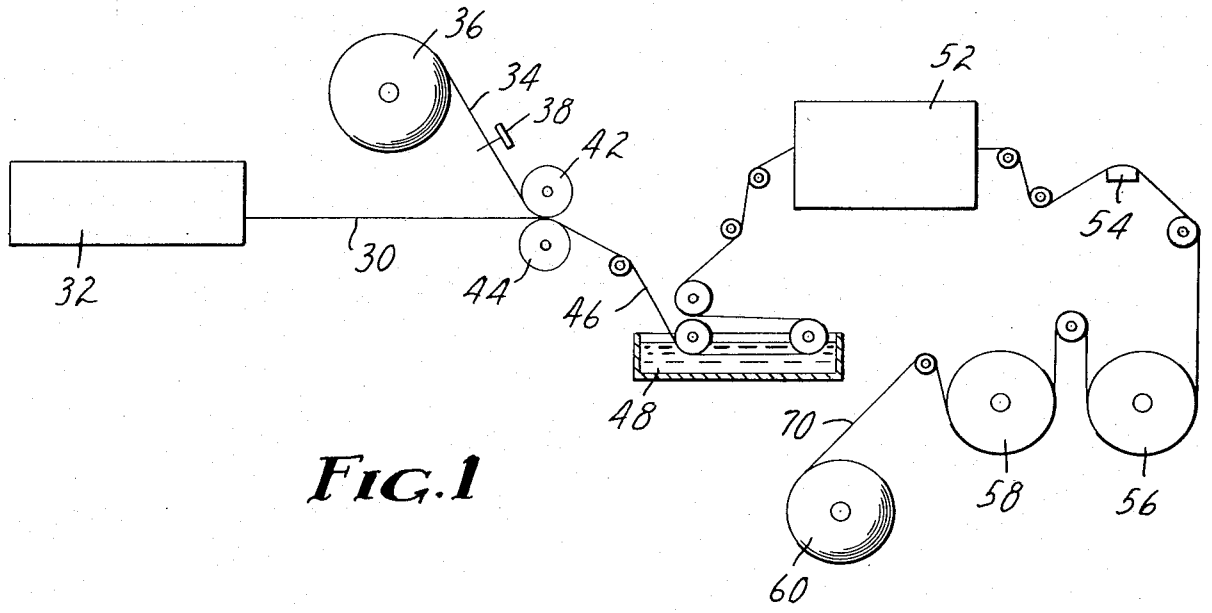
FIG. 1 is a schematic diagram of an apparatus which can be used for producing the sheet material according to the invention.

The decorative sheet material of the invention has a tissue-like base layer of thermally bondable polymeric binder fibers (hereinafter "binder fibers"). Thermally adhered to this base layer is at least a monolayer of substantially parallel, continuous, multifilament, non-cellulosic, thermoplastic yarns (hereinafter "multifilament yarns").

The function of the thermally bondable binder fibers is to provide an autogenous interbonded stable base for the sheet material, to adhere the multifilament yarns to the base layer, and to provide the sheet material with heat sealability. The term "heat sealability" means that the base layer side of the sheet material can be fused to various fibrous substrates, such as a second sheet material, paper stock, cardboard, or tissue paper, by such heat sealing means as heated rolls, heat guns, sonic sealers, lasers, hot wheel-type sealers and laminators. The binder fibers have at least an outer portion which is bondable, i.e., meltable or fusable, when subjected to thermal energy such as may be provided by heat, sonic, or laser energy sources.

The temperature at which at least the outer portion of the binder fibers melt is preferably in the range of about 225° to 400° F. (110° C. to 200° C.), more preferably 225° to 250° F. (110° C. to 125° C.). The binder fibers can be of any polymeric fiber-forming material such as polyester, polyamide, polyolefin, or combinations thereof provided that at least the outer portion is thermally bondable. Preferred binder fibers are of the core-and-sheath-type, having a sheath which melts to form bonds at the desired temperature and a core which melts at a temperature at least 50° F. (30° C.) above the melting temperature of the sheath. The higher melting core provides strength to the base layer and thus to the final sheet material. The binder fibers useful in the base layer include both continuous filament and staple fibers. Where fibrous material is used with the binder fibers in the base layer, the binder fibers should be staple fibers for ease of blending. The binder fibers may be continuous filament where the base layer contains 100 weight percent binder fibers. Continuous filament fibers are preferable formed into a web from spinnerets for use as the base layer. Formation of nonwoven webs directly from spinnerets is well known. The staple length binder fibers preferably have a length of ¼ to 6 inches (0.6 to 15 cm), more preferably 1 to 3 inches (2.5 to 7.5 cm). Fibers which are too long may be difficult to process, e.g., to form a sufficiently intimate blend where other fibers are present.

The binder fibers preferably have a denier in the range of 0.5 to 10 denier, more preferably 1 to 6 denier. The finer denier fibers generally provide greater softness to the sheet material. Of course, the binder fibers can be of a combination of different lengths and/or deniers to achieve a desired balance of properties.

The binder fibers should be present in the base layer in an amount of at least 50 weight percent to provide sufficient bonding within the base layer and adherence of the base layer to the multifilament yarns. Preferably, the base layer is comprised of 100 weight percent binder fibers for optimum bonding within the base layer and adherence to the multifilament yarns to achieve desirable high strength and integrity within the sheet material.

The base layer may optionally contain fibrous non-thermobonding material (hereinafter "fibrous material"). Such fibrous material include, e.g., polymeric staple fibers such as polyester, nylon, polypropylene, acetate, rayon, and acrylic, as well as natural fibers, such as cotton, and wood pulp. The addition of fibrous material to the base layer generally increases the softness and suppleness of the sheet material. The base layer may contain up to 50 weight percent fibrous material. However, as the amount of fibrous material increases, the strength of the base layer, and thus, the sheet material is reduced.

When fibrous material is present in the base layer, particularly in large amounts, e.g., 30 to 50 weight percent, thermobonding resin can be added to the base layer to increase the integrity of the base layer. Examples of such thermobonding resins include acrylic resins, vinyl acrylic resins, styrene acrylic resins, ethylene vinyl acetate resins, and polyvinyl acetate resins. The thermobonding resin can be used in an amount of 0 to 20 weight percent or more, based on the weight of the binder fiber and fibrous material in the base layer.

The continuous multifilament thermoplastic yarns which are thermally adhered to the base layer by the binder fibers through the action of heat and pressure, provide a satin-like, high sheen surface. The multifilament yarns can be of any non-cellulosic thermoplastic fiber forming material, such as polyester, polyamide, or polypropylene, as long as the yarn has a melt temperature at least 30° greater than that of the thermobonding portion of the binder fiber. The multifilament yarns are substantially parallel, aligned along the length of the sheet surface, and substantially cover one side of the base layer. The multifilament yarns are preferably uncrimped and untwisted to obtain maximum sheen where such surface character is desired. The multifilament yarns preferably have a denier/filament in the range of between about 1 and 10, more preferably 3 and 5. The finer the denier/filament, the more satin-like the surface becomes. Total denier of the multifilament yarns can range between 50 and 2500. The term "multifilament yarn" as used herein includes filament tow which can be spread to cover the base layer.

The relative amounts of base layer and multifilament yarn depend on the characteristics desired for particular end uses. Generally, the base layer has a weight in the range of about 10 to 25 lbs/ream (17 to 42 g/m$^2$) when the sheet material is to be used for molding or laminating, about 15 to 25 lbs/ream (25 to 42 g/m$^2$) when the sheet material is to be used in decorative pressure-sensitive adhesive tape, and about 14 to 18 lbs/ream (23 to 30 g/m$^2$) when the sheet material is to be used in decorative ribbon. Generally, the multifilament yarn is provided in an amount of 18 to 50 lbs/ream (30 to 84 g/m$^2$). The amount of multifilament yarn is also dependent on the denier of the yarn. Where less pliability is required, as for molding and laminating, higher denier/filament yarns can be used, resulting in greater filament yarn weight per unit area. Where greater pliability is required, as in decorative ribbon, lower denier/filament yarns, e.g., 4 denier per filament or less, can be used, resulting in less filament yarn weight per unit area.

The sheet material can optionally have a protective coating of sizing applied to the laminated sheet material to prevent fuzziness of the multifilament yarn surface during additional processing steps such as cutting, slitting, and molding or during use. Suitable sizing materials include acrylic resins, vinyl resins, vinyl acrylic resins, styrene acrylic resins, ethylene vinyl acetate resins, and polyvinyl acetate resins. The sizing is generally applied to the sheet material as a superficial coating which does not substantially penetrate the sheet material or serve to adhere the filaments together. Generally the amount of sizing is in the range of about 1 to 15 weight percent based on the weight of the material.

The sheet material may also optionally be dyed or printed to impart the desired coloration for decorative end uses. The dyes selected are preferably those which dye the binder fiber and the multifilament yarn as well as provide color to the fibrous material, thermobonding resin, and sizing where present. Metallic surfaces can be provided, such as by vapor-deposition of aluminum or copper onto the multifilament yarn surface. Coloration may also be provided by using predyed or dope-dyed multifilament yarn.

Referring to FIG. 1, which shows apparatus suitable for producing the sheet material of the invention. A base layer 30 of binder fibers is formed by a web forming apparatus 32 such as direct deposition of filament from fiber forming spinnerets or, from staple fiber using a carding machine, a Garnett machine, or a "Rando-Webber", manufactured by Curlator Corp.

Multifilament yarns 34 of warp 36 are supplied through condensing comb 38 and are brought in contact with base layer 30 at heated nip rolls 42 and 44 to effect autogenous bonding at the base layer and thermal bonding of the multifilament yarns 34 to the base layer 30. The temperature of nip rolls 42 and 44 should be sufficient to effect thermal bonding between the components of the sheet material. The temperature should be less than that at which the multifilament yarns melt. Where the binder fibers are of the sheath and core type, the temperature should not be so high as to melt the fiber core. Nip roll 44 preferably is provided with a release surface, such as Teflon ® film, to prevent adhesion of base layer 30 thereto. The pressure exerted by the nip rolls should be sufficient to cause intimate contact of the multifilament yarns and the base layer without forcing the filaments into the layer to such an extent that the satin-like appearance provided by the filament yarns is lost.

Figure 2:
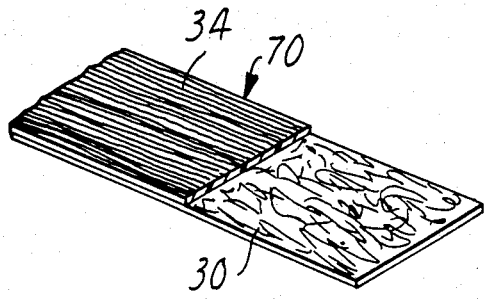
FIG. 2 is a schematic cut-away perspective view of sheet material according to the invention.

The laminated sheet material 46 can then optionally be passed through bath 48 which contains sizing and/or dye solution and dried in drying oven 52. The sheet material is passed over anti-wrinkle slat 54 and heated ironing drums 56 and 58 to smooth the sheet material. The finished smooth sheet material 70 can then be wound on roll 60. As shown in FIG. 2, the finished sheet material 70 has multifilament yarns 34 laminated to base layer 30.

The sheet material can be produced in a multi-step process as well as by the continuous process described hereinabove. In the multi-step process, a web can be formed by direct deposition of filament from fiber forming spinnerets or by using a carding machine, Garnett machine or "Rando-Webber" to form the web from staple fiber. This web may be directly taken up on a roll or autogenously bonded by passing the web through heated nip rolls prior to take-up to form the base layer. The web or base layer can later be unwound, brought in contact with multifilament yarn supplied from a beam and then passed through nip rolls 42 and 44 to laminate the yarn to the base layer as shown in FIG. 1. The laminated sheet material can be taken up on a roll or sizing and dye can be applied in-line with subsequent drying and ironing as shown in FIG. 1. When the sheet material is taken up in a roll immediately after lamination, it can, of course, be dyed and ironed at a later time. Where pre-colored multifilament yarns are used, the base layer can be optionally dyed before the multifilament yarns are bonded thereto.

When optional fibrous materials are used in the base layer, they are generally blended with the binder fiber prior to, or during, the web-forming step. When optional thermobonding resin is optionally applied to the base layer web, it is generally applied after the web-forming step by spraying, kiss roll application, or both, followed by a drying step.

Figure 3:
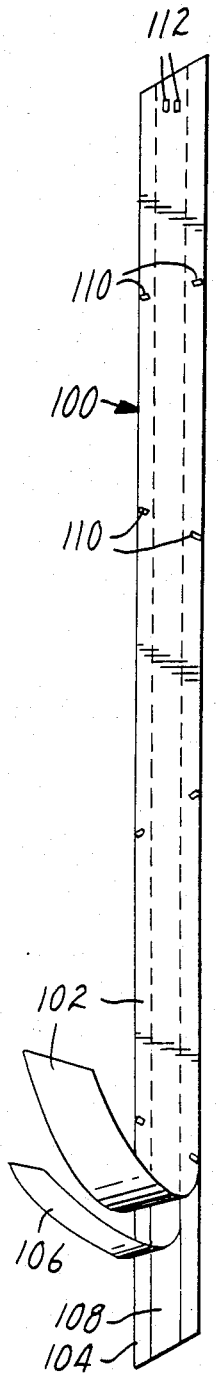
FIG. 3 is a front plan view of a ribbon assembly according to the invention.

The sheet material can be slit to form ribbon which may be packaged as rolls of ribbon or used to produce ribbon assemblies 100 as shown in FIG. 3 such as 3M Bow Magic TM Brand Bows and the ribbon assemblies disclosed in U.S. Pat. No. 4,329,382 which is incorporated herein by reference. The sheet material is particularly suited for ribbon and ribbon assemblies because the multifilament yarns provide a rich lustrous face surface while the base layer provides a surface with sufficient texture to inhibit tied knots and formed bows of such ribbon from sliding apart. Ribbon assemblies are generally formed from four layers of sheet material slit to ribbon width, outer members 102 and 104 and inner members 106 and 108, each member being of substantially the same length. A single inner member may be used although two inner members are generally preferred for aesthetic reasons. Inner members 106 and 108 are narrower than outer members 102 and 104 and are arranged such that they are spaced from the edges of outer members 102 and 104. Outer members 102 and 104 are usually of substantially the same width. The base layers of the sheet material of inner members 106 and 108 are in face to face contact. The base layers of the sheet material of outer members 102 and 104 are in contact with the acetate filament surface of inner members 106 and 108. Outer member 102 is intermittantly bonded to outer member 104 at points of attachment 110. All four members of the ribbon assembly are bonded together near an end portion thereof by end seal 112. The sheet material is particularly useful for ribbon assemblies because the points of attachment 110 and end seals 112 can be heat-sealed such as by sonic welding. Where the points of attachment 110 are formed by direct contact of the sheet material with a heat source, the base layers being in face to face contact, the direct contact of the heat source is with the multifilament yarn surface. This minimizes adherence of the heat source to the sheet material.

Figure 4:
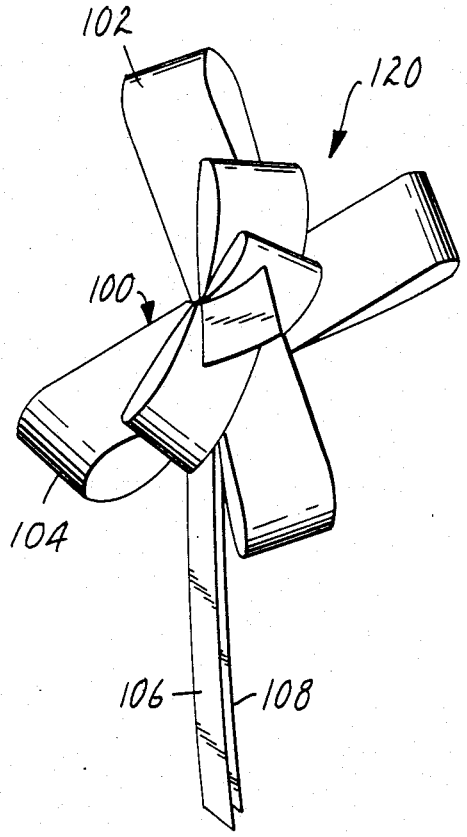
FIG. 4 is a perspective view of a bow formed from the ribbon assembly of FIG. 3.

The ribbon assemblies 100 are useful for forming decorative bows 120 as shown in FIG. 4. Decorative bow 120 is formed from ribbon assembly 100 by sliding the ends of outer members 102 and 104 distant from end seal 112 toward end seal 112 over inner members 106 and 108 such that outer members 102 and 104 form bow 120 with inner members 106 and 108 extending therefrom. The shape of bow 120 is determined by the spacing of points of attachment 110 in the ribbon assembly.

Figure 5:
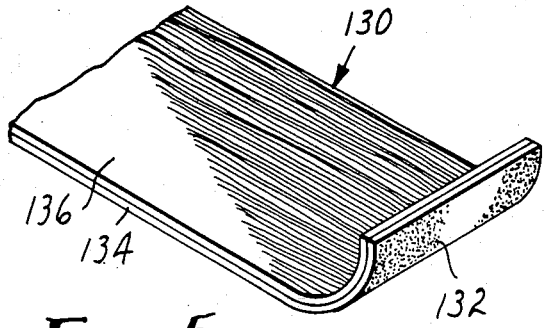
FIG. 5 is a perspective view of a pressure-sensitive adhesive tape according to the invention.

A decorative pressure-sensitive adhesive tape 130, as shown in FIG. 5, can be produced from the sheet material. Such tapes can be produced by applying conventional pressure-sensitive adhesive 132 to the surface of the base layer 134 of the sheet material, the multifilament yarn surface 136 of the sheet material being on the surface opposed to that having the adhesive applied thereto. Suitable adhesives include those which can be applied and dried at a temperature less than the softening temperature of the binder fiber and the resin. Examples of suitable adhesives include transfer adhesives and hot melt adhesives.

Figure 6:
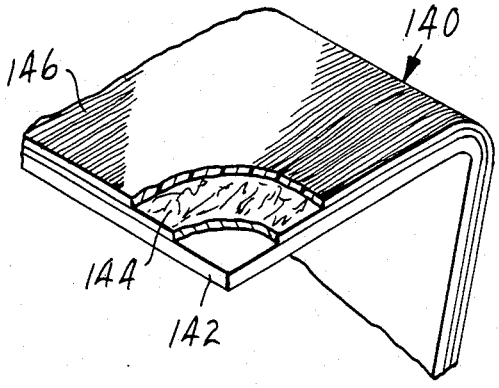
FIG. 6 is a cut-away perspective view of a laminated article according to the invention.

The sheet material can also be laminated to fibrous substrates to form laminated decorative articles 140, such as matchbook covers and card stock, as shown in FIG. 6. The base layer 144 of the sheet material is brought in contact with the fibrous substrate 142 and the composite is heated under sufficient pressure, e.g., 50 to 150 psi (3.5 to 10.5 kg/cm$^2$), at a temperature sufficient to effect bonding between the sheet material and the substrate, generally about the same temperature used to laminate the multifilament yarn to the base layer. The pressure and temperature should not be so high as to cause damage to the multifilament yarn surface 146.

Figure 7:
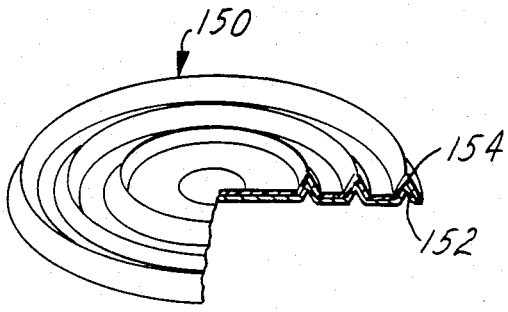
FIG. 7 is a cut-away perspective view of a molded article according to the invention.

The sheet material can be molded to form decorative shaped articles 150, as shown in FIG. 7, due to the thermoformability of the sheet material provided by the binder fibers and the thermobonding resin. The sheet material can be molded at pressures in the range of about 1 to 2 atmospheres and at a temperature sufficient to soften the base layer 152 of the sheet material, generally about the same temperature used to laminate the multifilament yarn 154 to the base layer 152.

Figure 8:
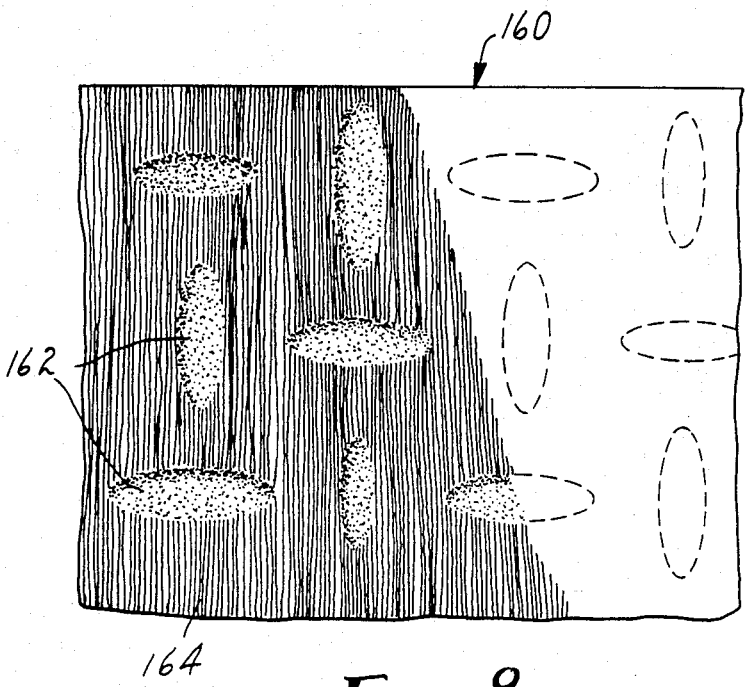
FIG. 8 is a top plan view, greatly enlarged, of embossed sheet material according to the invention.

The sheet material can also be embossed under heat and pressure, to give various surface patterns and effects. The sheet material can be embossed under heat and pressure to modify the surface appearance of the multifilament yarn face of the sheet material. For example by proper selection of the embossing pattern the multifilament yarn surface can have the appearance of a woven or knitted fabric. FIG. 8 shows the embossed surface of sheet material 160, greatly enlarged, produced by pressing heated window screening material into the surface resulting in embossed areas 162 imposed on the filament surface 164. In the embossed areas, the filaments are pressed into the base layer and are less visible, while in the unembossed areas the filament yarn character remains on the surface of the sheet material. Such embossed sheet material has the appearance of woven fabric. Known embossing methods, such as embossing presses and embossing rolls, can be used to modify the surface. The sheet material should be heated to a temperature sufficient to soften the base layer of the sheet material during embossing.

Figure 9:
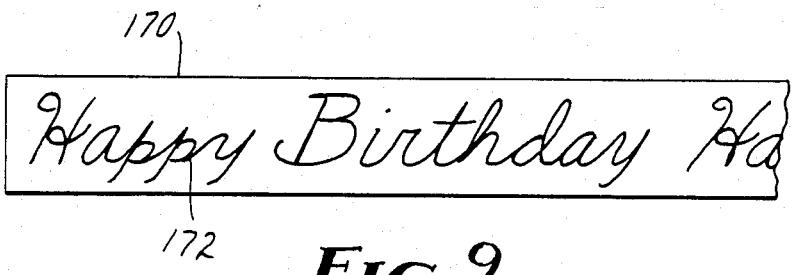
FIG. 9 is a top plan view of printed sheet material according to the invention.

The sheet material can be printed to further enhance the decorative surface. As shown in FIG. 9 slit ribbon 170 can be printed with congratulatory or seasonal messages 172. Sheet material wide goods can be printed to provide products such as wall coverings. Protective coatings such as vinyl resins can be applied to the printed multifilament yarn surface to provide washability and to provide protection from damage due to environmental sources such as dirt and water.

EXAMPLE 1

Sheet material was prepared using a multistep process as described hereinabove. A web was formed using a Garnett machine, the web containing 100 weight percent polyester binder fiber (4 denier, 1¼ inch (32 mm) length, "Melty" brand, available from Unitika, Ltd., Japan). The web weight was 17 lbs per ream (29 g/m$^2$).

Polyester yarns (320 denier/90 filament/0 twist, type bright, 100% low-shrink, available from Celanese Co.) were supplied from a warp beam through a comb at 42 ends/inch. The yarns were brought into contact with the web at a laminating drum and the binder fibers were autogenously bonded and the polyester yarns were laminated to the web using a laminating drum temperature of 380° F. (193° C.), a contact time of 1 second, and 40 lb per inch (7 kg/cm) width exerted by the pressing rolls.

The laminated sheet material was then passed through a sizing/dye bath containing:

1% Rhoplex P-376 acrylate resin (available from Rohm and Haas Company)

1% Polyester Blue NRBS Paste (available from Eastman Chemical Products, Inc.)

98% water

The solids pick-up with the dye and resin sizing contributed about 1 lb per ream (1.7 g/m$^2$) on the weight of the laminated sheet material. The resulting sheet material was dried at 250° F. (120° C.) for 30 seconds.

The dried sheet material was passed over an anti-wrinkle slat and then over a first ironing drum steam heated to a temperature of 200° F. (93° C.) and a second ironing drum steam heated to a temperature of 200° F. (93° C.).

The resulting sheet material had a lustrous satin-like appearance with rich blue color on the multifilament yarn face side and a blue matte surface on the base layer side.

The sheet material was tested for break strength using ASTM Test Method D-828. The sheet material had a break strength of 164.2 lb/inch (29.2 kg/cm) width in the machine direction and 4.7 lb/inch (0.8 kg/cm) width in the cross-machine direction.

The sheet material was slit to 1 inch width and was tested for knot tie strength using ASTM Test Method D-828. The sheet material had a knot tie strength of 103 lbs/inch (18.3 kg/cm) width.

The sheet material was slit in 1" and ½" ribbon widths and a bow assembly of the type shown in FIG. 3 was made by sonically welding the points of attachment using a Branson-Integrated ultrasonic welding system at a silver booster-gap setting of 3 mil (0.076 mm) on the anvil to provide a ⅛ inch (0.32 cm) pin seal. The strength of the pin seals were tested by severing the ribbon assembly on each side of a weld, 1 inch from the weld, removing the inner layers of the ribbon assembly, folding each outer layer such that the acetate filament surface contacts itself. The outer layer portions are pulled apart at the seal at a rate of 5 inches per minute. The sonic welds had an average strength of 20.9 oz. (593 g).

EXAMPLE 2

Sheet material was prepared as in Example 1 and slit to ½ inch (1.25 cm) width. A pressure-sensitive adhesive tape was prepared by applying to the base layer surface an adhesive transfer tape (No. 924, ½ inch (1.25 cm) wide, available from 3M Company) using an adhesive transfer gun applicator (No. ATG 752, available from 3M Company). The adhesive adhered well to the sheet material and provided an excellent decorative pressure-sensitive adhesive tape.

EXAMPLE 3

Sheet material was prepared as in Example 1. A 4-inch (10-cm) wide by 4-inch (10-cm) long piece of the sheet material was placed on a similar size piece of 8-point clay coated bending chipboard with the base layer surface of the sheet material in contact with the cardstock. The sheet material was laminated to the cardstock using a press at a temperature of 225° F. (107° C.), a pressure of 90 lb/sq. inch (6.3 kg/cm$^2$), and a contact time of two seconds. The laminated decorative material was suitable for matchbook covers or greeting cards.

EXAMPLE 4

Sheet material, was prepared as in Example 1, was place in a vacume former between a bottom aluminum male mold and a top urethane female mold. A rubber blanket was placed over the mold to enable a vacuum to be drawn. The sheet material was molded at 250° F. (120° C.) using a vacuum of about one atmosphere for 10 seconds. The molded article, shown in FIG. 8 was suitable for use as a decorative medallion.

EXAMPLE 5

Sheet material was prepared as in Example 1. A 4-inch (10-cm) wide by 4-inch (10-cm) long piece of sheet material was placed on a press. A sheet of window screen was placed on each side of the sheet material. The screen/sheet material/screen sandwich was pressed at a temperature of 250° F. (120° C.) and a pressure of 90 lb/sq. inch (6.3 kg/cm$^2$) for 2 seconds to emboss the screen pattern into the surface of the sheet material. The sheet material was removed from the press. The embossed sheet material had the appearance of a woven fabric.

EXAMPLE 6

Sheet material was prepared using a multistep process as in Example 1. A web was formed, using a Garnett machine, the web containing 75 weight percent polyester binder fiber (4 denier, 1¼ inch (32 mm) length "Melty brand", available from Unitka, Ltd., Japan) and 25 weight percent viscose rayon (1.5 denier, 1 9/16 inch (40 mm) length, type bright, available from American Enka). The web weight was 15 lbs/ream (25 g/m$^2$).

The web was coated with an aqueous solution containing thermobonding resin ("Rhoplex" P-376, available from Rohm and Haas Company) and dried at 250° F. (120° C.) for 46 seconds to produce the base layer. The base layer contained 10 weight percent resin based on the weight of the staple fiber web. Polyester multifilament yarns were laminated to the base layer as in Example 1.

The thus-formed sheet material was tested for breaking strength and knot tie strength using ASTM Test Method D-828. The breaking strength was 139.0 lb/inch (24.7 kg/em) width in the machine direction and 4.2 lb/inch (0.75 kg/cm) width in the cross-machine direction. The knot-tie strength was 102.2 lb/inch (18.2 kg/cm) width.

Various modifications and alterations of this invention will become apparent to those skilled in the art without departing from the scope of this invention.

We claim:

1. Decorative sheet material comprising (a) A thermally bonded nonwoven tissue-like base layer having at least 50 weight percent polymeric, staple fibers having a length in the range of ¼ to 6 inches and up to about 50 weight percent other fibrous material, at least the outer portion of said fibers being thermally bondable, and (b) at least a monolayer of a multiplicity of substantially parallel, continuous, non-cellulosic, multifilament yarns substantially covering a first side of said base layer and thermally laminated to said base layer, at least one side of said base layer being sonically bondable to a fibrous substrate.

2. The decorative sheet material of claim 1 further comprising from 0 to 20 weight percent thermobonding resin based on the weight of the base layer fibers.

3. The decorative sheet material of claim 1 further comprising a protective sizing layer over said monolayer of filament yarns.

4. The decorative sheet material of claim 1 wherein said thermally bondable fibers are in the range of about 0.5 to 10 denier.

5. The decorative sheet material of claim 1 wherein said thermally bondable fibers are core-and-sheath-type fibers, said sheath having a melting point in the range of about 110° C. to 200° C.

6. The decorative sheet material of claim 5 wherein said fibers are polyester.

7. The decorative sheet material of claim 1 wherein said fibrous material is in the range of from about ¼ to 6 inches in length.

8. The decorative sheet material of claim 1 wherein said fibrous material is in the range of from about 0.5 to 10 denier.

9. The decorative sheet material of claim 2 wherein said thermobonding resin is selected from acrylic, vinyl acrylic, styrene acrylic, ethylene vinyl acetate, and polyvinyl acetate resins.

10. The decorative sheet material of claim 3 wherein said sizing layer is a material selected from the group consisting of acrylic resins, vinyl resins, vinyl acrylic resins, styrene acrylic resins, ethylene vinyl acetate resins, and polyvinyl acetate resins.

11. The decorative sheet material of claim 1 wherein said multifilament yarns are in the range of about 50 to 2500 total denier.

12. The decorative sheet material of claim 11 wherein each filament of said yarn has a denier in the range of between about 1 and 10.

13. The decorative sheet material of claim 1 wherein said nonwoven base layer weighs in the range of 10 to 25 lbs/ream.

14. The decorative sheet material of claim 1 wherein said continuous filament yarn weighs in the range of 18 to 50 lbs/ream.

15. A decorative pressure-sensitive adhesive tape comprising the sheet material of claim 1 and pressure-sensitive adhesive on the side of said material opposite that having said filament yarns thereon.

16. A decorative ribbon comprising the material of claim 1.

17. A ribbon assembly comprising: first and second outer members of ribbon-width sheet material of claim 1, said outer members being spaced apart, longitudinally aligned, and of approximately the same length and having said base layers in face to face arrangement; spaced apart, thermally sealed, points of attachment along the longitudinal periphery of said outer members; at least one inner member extending the length of said outer members and residing within the space formed by said outer members and said points of attachment; and a thermally sealed end seal near one end of said inner and outer members which seals said members together, such that the end of said inner member distant said end seal can be held and said outer members can be slid along said inner member toward said end seal to form a decorative bow.

18. A laminated article comprising a fibrous substrate and a layer of the material of claim 1 over at least a portion of said substrate, said material being directly thermally bonded to said substrate.

19. A molded article comprising the material of claim 1.

20. An embossed article comprising the sheet material of claim 1 having a pattern embossed thereon.

21. A printed article comprising the sheet material of claim 1 having printing thereon.

22. A process for producing a decorative sheet material comprising (a) forming a tissue-like nonwoven web of at least about 50 weight percent polymeric, staple fibers having a length in the range of ¼ to 6 inches and up to 50 weight percent other fibrous material, at least the outer portion of said fibers being thermally bondable, (b) laying a multiplicity of parallel continuous multifilament non-cellulosic thermoplastic yarns on said web to substantially cover the surface of one side of said web, (c) heating said yarn covered web under sufficient temperature and pressure to cause said yarns to bond to said web, (d) passing said yarn covered web through a bath containing sizing solution, and (e) drying said sized web.

23. The process of claim 22 wherein said process further comprises dyeing said yarn covered web as the web is being passed through the bath containing the sizing solution.

24. The decorative sheet material of claim 3 wherein said sizing is present in an amount in the range of from about 1 to about 15 weight percent, based on the weight of said sheet material.

25. The decorative sheet material of claim 5 wherein said fibers are polyolefin.

26. The ribbon assembly of claim 17 wherein said spaced apart, thermally sealed, points of attachment along the periphery of said outer members are sealed by means of sonic bonding.

27. The ribbon assembly of claim 17 wherein said thermally sealed end seal is sealed by means of sonic bonding.

* * * * *